United States Patent [19]

Moriya et al.

[11] Patent Number: 4,460,455

[45] Date of Patent: Jul. 17, 1984

[54] PROCESS FOR PRODUCING PITCH FOR USING AS RAW MATERIAL FOR CARBON FIBERS

[75] Inventors: Kunihiko Moriya, Tokyo; Kazuhito Tate, Kanagawa; Goro Muroga, Tokyo; Kazuhiro Yanagida, Kanagawa, all of Japan

[73] Assignee: Mitsubishi Oil Co., Ltd., Tokyo, Japan

[21] Appl. No.: 456,454

[22] Filed: Jan. 7, 1983

[30] Foreign Application Priority Data

Jan. 13, 1982 [JP] Japan ..... 57-2648

[51] Int. Cl.[3] ..... C10C 3/06; C10G 45/00

[52] U.S. Cl. ..... 208/40; 208/71; 208/89; 208/45; 423/447.4

[58] Field of Search ..... 208/71, 89, 45, 40; 423/447.1, 447.2, 447.4, 447.6, 449

[56] References Cited

U.S. PATENT DOCUMENTS

| | | | |
|---|---|---|---|
| 2,992,181 | 7/1961 | Renner et al. | 208/71 |
| 3,272,734 | 9/1966 | MacLaren | 208/89 |
| 3,330,759 | 7/1967 | Henschel et al. | 208/40 |
| 3,355,377 | 11/1967 | King | 208/40 |
| 4,028,224 | 6/1977 | MacDonald et al. | 208/92 |
| 4,162,213 | 7/1979 | Zunskull, Sr. et al. | 208/89 |
| 4,165,274 | 8/1979 | Kwant | 208/92 |
| 4,271,006 | 6/1981 | Dickakian | 208/45 |
| 4,363,715 | 12/1982 | Dickakian | 208/40 |

FOREIGN PATENT DOCUMENTS

| | | | |
|---|---|---|---|
| 63051 | 7/1981 | European Pat. Off. | 208/22 |
| 2751863 | 11/1976 | Fed. Rep. of Germany | 208/89 |

*Primary Examiner*—Delbert E. Gantz
*Assistant Examiner*—Helane E. Maull
*Attorney, Agent, or Firm*—Sughrue, Mion, Zinn, Macpeak & Seas

[57] ABSTRACT

A process for producing a pitch used as a raw material for producing carbon fibers is disclosed. The process comprises the steps of carrying out catalytic cracking of a hydrogenated residual oil prepared by hydrogenation treatment of a petroleum heavy residual oil or a mixture composed of said hydrogenated residual oil and a hydrogenated distillate oil which is prepared by hydrogenation treatment of a reduced pressure distillate oil prepared by reduced pressure distillation of the petroleum heavy residual oil. The resulting cracking oil is then distilled to produce a high boiling point fraction having a boiling point of 300° C. or more. The fraction is then subjected to thermal modification. The pitch is then utilized to produce carbon fibers which have desirable characteristics. The process is advantageous in that it makes possible the use of a wide variety of different types of oils in order to produce a pitch which can be utilized in producing carbon fibers having desirable characteristics.

1 Claim, No Drawings

PROCESS FOR PRODUCING PITCH FOR USING AS RAW MATERIAL FOR CARBON FIBERS

FIELD OF THE INVENTION

The present invention relates to a process for producing a pitch (which is a raw material for producing carbon fibers having a high modulus of elasticity), using a petroleum heavy residual oil.

BACKGROUND OF THE INVENTION

In pitches which are used as a raw material for producing carbon fibers having excellent strength and excellent modulus of elasticity, optical anisotropy is observed by a polarizing microscope. It has been believed that such pitches contain a mesophase. Further, it has recently been disclosed that carbon fibers having a high modulus of elasticity can be produced with a pitch containing a neomesophase which develops an optical anisotropy after it is heated for a short time. On the other hand, the pitches used as a raw material for carbon fibers need not possess only optical anisotrophy but must also be capable of being stably spun. However, it is not easy to produce pitches having both properties.

Accordingly, in order to produce carbon fibers having excellent strength and excellent modulus of elasticity, it is not always possible to use any material as the raw material for making pitches. Materials having specified properties are required. However, in many published patents, for example, U.S. Pat. Nos. 3,976,729 and 4,026,788, the raw material is not specifically described in the patent specifications and it appears as if pitches used as a raw material for carbon fibers can be produced by carrying out thermal modification of a wide variety of raw materials.

However, when the detailed descriptions and examples in such patents are examined in detail, it becomes apparent that desired pitches can only be produced by using specified raw materials described in the examples of such patents. For example, U.S. Pat. No. 4,115,527 discloses that substances such as chrysene or tarry materials by-produced during the high temperature cracking of petroleum crude oil are suitable for producing the pitch, i.e., a carbon fiber precursor, but conventional petroleum asphalts and coal tar pitches are not suitable.

U.S. Pat. No. 3,974,264 discloses that an aromatic base carbonaceous pitch having a carbon content of about 92 to 96% by weight and a hydrogen content of about 4 to 8% by weight is generally suitable for preparation of a mesophase pitch. It has been described that elements excepting carbon and hydrogen, such as oxygen, sulfur and nitrogen, should not be present in an amount of more than about 4% by weight, because they are not suitable. Further, it has been disclosed that the precursor pitch used in Example 1 of the same patent publication has properties comprising a density of 1.23 g/cc, a softening point of 120° C., a quinoline insoluble content of 0.83% by weight, a carbon content of 93%, a hydrogen content of 5.6%, a sulfur content of 1.1% and an ash content of 0.044%. Even if the density of 1.23 g/cc in these properties is maintained, petroleum fractions having such a high density are hardly known in conventional petroleum fractions. U.S. Pat. Nos. 3,976,729, 4,026,788 and 4,005,183 also describe examples wherein the pitch is produced using a specified raw material.

The properties of heavy petroleum oils actually depend essentially upon the properties of crude oils from which they were produced and the process for producing the heavy oil. However, it is rare for heavy oils to have the suitable properties described in the above examples, and such oils are often not available. Moreover, because petroleum resources are being exhausted it has become important to effectively utilize heavier petroleum fractions as raw materials for carbon fibers and to make it possible to produce carbon fibers at a moderate price. Accordingly, in order to produce carbon fibers having excellent strength and excellent modulus of elasticity industrially in a stabilized state at a moderate price using petroleum heavy oils, it is necessary to develop a process for producing a pitch wherein the properties of the finally resulting pitch are always kept in a fixed range even if the properties of the raw material used for making the pitch vary.

SUMMARY OF THE INVENTION

The present invention relates to a process for producing a pitch which is used for producing carbon fibers having a high modulus of elasticity. The pitch is produced industrially in a stabilized state using not only a specified raw material but also an easily available petroleum heavy residual oil.

The present invention relates to a process for producing a pitch used as a raw material for carbon fibers, comprising the steps of: carrying out catalytic cracking of a hydrogenated residual oil prepared by hydrogenation treatment of a petroleum heavy residual oil or a mixture composed of said hydrogenated residual oil and a hydrogenated distillate oil which is prepared by hydrogenation treatment of a reduced pressure distillate oil prepared by reduced pressure distillation of the petroleum heavy residual oil, distilling the resulting cracking oil to produce a high boiling point fraction having a boiling point of 300° C. or more, and subjecting said fraction to thermal modification.

DETAILED DESCRIPTION OF THE INVENTION

The petroleum heavy residual oils used as raw materials may be heavy residual oils of crude oils, such as atmospheric pressure distillation residual oils, hydrocracking residual oils and thermal cracking residual oils. As a property of the raw material, it is preferred that the sulfur content, vanadium content, nickel content and asphaltene content in the raw material become as small value as possible. These oils may be used alone or as a mixture of them.

The above-described petroleum heavy residual oils are subjected to hydrogenation treatment in the presence of a hydrogenation catalyst under conditions comprising a temperature of 370° to 450° C., preferably 380° to 410° C., a pressure of 70 to 210 kg/cm$^2$G, preferably 150 to 200 kg/cm$^2$G, a liquid space velocity of 0.4 to 2.0 (hr)$^{-1}$, preferably 0.4 to 1.0 (hr)$^{-1}$ and a ratio of hydrogen/oil of 700 to 1,700 Nm$^3$/kl, preferably 700 to 1,500 Nm$^3$/kl. By carrying out the hydrogenation treatment, impurities present in the heavy residual oils, such as sulfur, nitrogen and metals, etc., are removed and, at the same time, the amount of high molecular polycyclic aromatic components such as asphaltene is reduced. The conditions of the hydrogenation treatment are fixed so as to result in a sulfur content of the hydrogenated residual oil of 0.7% by weight or less, a vanadium content of 10.0 ppm or less, a nickel content of 5.0 ppm or less and an asphaltene component of 1.0% by weight or less.

The asphaltene component is one of the components in case of analyzing by solvent fractionation. It is insoluble in n-heptane but soluble in benzene. When the petroleum heavy residual oil used as a raw material has properties satisfying the above-described requirements of a sulfur content of 0.7% by weight or less, a vanadium content of 10.0 ppm or less, a nickel content of 5.0 ppm or less and an asphaltene component of 1.0% by weight or less, because of carrying out blending, etc. (before it is subjected to the hydrogenation treatment), it is possible to omit the hydrogenation treatment. Impurities in the pitch used as a raw material for carbon fibers, such as sulfur, nitrogen and metals must be removed, because they prevent improvement of strength and modulus of elasticity of the carbon fibers. However, since it is very difficult to remove these substances from the finally obtained pitch, their removal is carried out in a previous stage, where removal is comparatively easy. Further, it is necessary to reduce the amount of asphaltene component to a lower level than a prescribed value (i.e., 1.0% by weight or less) in order to prevent deposition of carbon and vanadium or nickel, etc., on the catalyst when carrying out catalytic cracking in the next step.

The above-described hydrogenated residual oil is generally subjected to a catalytic cracking reaction in the presence of a catalyst in the next step. However, when the amounts of vanadium and nickel, etc., in the hydrogenated residual oil are high, it is possible to carry out, if necessary, catalytic cracking by blending a hydrogenated distillate oil which is prepared by hydrogenation treatment of a reduced pressure distillate oil prepared by reduced pressure distillation of the petroleum heavy residual oil with the hydrogenated residual oil. This is done in order to extend the life of the catalytic cracking catalyst.

The hydrogenated distillate oil used for blending is obtained by a process which comprises processing a petroleum heavy residual oil by a reduced pressure distillation apparatus to obtain a distillate fraction having a boiling point of 300° to 550° C. (converting into values under an atmospheric pressure) and subjecting it to hydrogenation treatment in a presence of a hydrogenation catalyst under a condition comprising a temperature of 300° to 410° C., a pressure of 40 to 150 kg/cm$^2$G, a liquid space velocity of 0.5 to 3.0 per hour and a ratio of hydrogen/oil of 260 to 1,700 Nm$^3$/kl. By this hydrogenation treatment, impurities such as sulfur, nitrogen and metals, etc., are removed from the reduced pressure distillate oil. The condition of the hydrogenation treatment is fixed so as to result in a sulfur content in the hydrogenated distillate oil of 0.4% by weight or less. When the petroleum heavy residual oil using as a raw material is already subjected to hydrogenation treatment, such as the case of hydrocracking residual oil, etc., so that the distillate oil having a boiling point of 300° to 550° C. (converting into values under an atmospheric pressure) obtained by reduced pressure distillation already has a sulfur content of 0.4% by weight or less, it is possible to omit the hydrogenation treatment step for the reduced pressure distillate oil. In the catalytic cracking reaction step, the above-described hydrogenated residual oil or a mixture obtained by blending a hydrogenated distillate oil with the hydrogenated residual oil is subjected to a catalytic cracking reaction in the presence of a catalyst comprising silica-alumina or silica-magnesia as main components or a zeolite catalyst, etc., under conditions comprising a temperature of 470° to 540° C., a pressure of 0.5 to 5.0 kg/cm$^2$G and a ratio of catalyst:oil of 5:1 to 15:1 (by weight). A high boiling point fraction having a boiling point of 300° C. or more is obtained by distillation of the resulting cracking oil. Then, the resulting high boiling point fraction is subjected to thermal modification at a temperature of 390° to 450° C. for 1 to 30 hours, whereby a pitch used as a raw material for producing carbon fibers having a high modulus of elasticity can be obtained. The residual heavy fraction after carried out the catalytic cracking reaction has properties the difference of which due to raw materials becomes smaller by the cracking reaction together with the above-described hydrogenation treatment. Further, it has a chemical composition such that the amount of aromatic compounds is large. Practical conditions in each step of the above-described process are suitably fixed considering properties of the petroleum heavy residual oil using as a raw material and properties of the pitch used as a raw material for carbon fibers as a final product, whereby it becomes possible to reduce the difference in the properties of the starting raw material and to keep the properties of the pitch used as a raw material for carbon fibers in a fixed range.

Since the properties of the petroleum heavy oil used as a starting raw material are fairly different from each other depending on the kind of crude oil it is generally difficult to produce a pitch having fixed properties having a high strength and high modulus of elasticity by carrying out only thermal modification of such a petroleum heavy oil.

According to the present invention, it is possible to convert petroleum heavy residual oils having a wide range of properties which cannot be used as pitches for producing carbon fibers by the prior processes into a raw material for carbon fibers having a high modulus of elasticity, industrially and economically in a stabilized state, by carrying out a series of processings comprising hydrogenation treatment→catalytic cracking→distillation→thermal modification.

The pitch thus produced by the invention is utilized to produce the carbon fiber. The carbon fiber can be produced by the conventional processes, for example, the process as described in U.S. Pat. No. 3,767,741 which comprises spinning the pitch as a raw material, infusiblizing and then carbonizing.

In the following, the present invention is illustrated in greater detail by examples. However, this invention is not limited to these examples.

EXAMPLE 1

An atmospheric pressure distillation residual oil of Middle East crude oil A was subjected to hydrogenation treatment in the presence of a cobalt-molybdenum catalyst under conditions comprising a temperature of 390° C., a pressure of 160 kg/cm$^2$G, a liquid space velocity of 0.5 per hour and a ratio of hydrogen/oil of 1,000 Nm$^3$/kl to obtain a hydrogenated residual oil. The resulting hydrogenated residual oil was allowed to carry out a catalytic cracking reaction with a zeolite catalyst under a condition comprising a temperature of 510° C., a pressure of 1.5 kg/cm$^2$ G and a ratio of catalyst/oil of 9 (by weight). After the catalytic cracking reaction, the residual heavy oil was distilled to obtain a high boiling point fraction having a boiling point of 300° C. or more, and the resulting high boiling point fraction was subjected to thermal modification at 410° C. for 20 hours to obtain a pitch used as a raw material for carbon fibers. Properties of the atmospheric pressure distillation residual oil of Middle East crude oil A used as a raw material, those of the hydrogenated residual oil after hydrogenation treatment, those of the high boiling point fraction after catalytic cracking treatment and those of the pitch used as a raw material for carbon fibers are shown in Table 1.

Further, carbon fibers which were obtained by carrying out melt spinning of the above-described pitch used as a raw material for carbon fibers at 350° C., infusiblizing at 260° C. in the air and carbonizing at 1,000° C. had a tensile strength of 12 tons/cm$^2$ and a modulus of elasticity of 1,250 tons/cm$^2$. When the fibers prepared by carbonizing at 1,000° C. were additionally graphitized at 2,000° C., they had a tensile strength of 13 tons/cm$^2$ and a modulus of elasticity of 2,300 tons/cm$^2$.

EXAMPLE 2

An atmospheric pressure residual oil of Middle East crude oil B was processed in the presence of a cobalt-molybdenum catalyst under conditions comprising a temperature of 390° C., a pressure of 160 kg/cm$^2$G, a liquid space velocity of 0.5 per hour and a ratio of hydrogen/oil of 1,000 Nm$^3$/kl to obtain a hydrogenated residual oil.

On the other hand, an atmospheric pressure residual oil of Middle East crude oil A was distilled under a reduced pressure to obtain a reduced pressure distillate oil having a boiling point of 300° to 550° C. (converting into values under an atmospheric pressure). The resulting reduced pressure distillate oil was subjected to hydrogenation treatment in the presence of a cobalt-molybdenum catalyst under conditions comprising a temperature of 380° C., a pressure of 60 kg/cm$^2$G, a liquid space velocity of 1.8 per hour and a ratio of hydrogen/oil of 360 Nm$^3$/kl to obtain a hydrogenated distillate oil. The above-described hydrogenated residual oil and the hydrogenated distillate oil were mixed in a ratio of 1:1 by weight, and the resulting mixed oil was allowed to carry out a catalytic cracking reaction with a zeolite catalyst under a condition comprising a temperature of 500° C., a pressure of 1.4 kg/cm$^2$G and a ratio of catalyst/oil of 9 (by weight). The residual heavy fraction after the catalytic cracking reaction was distilled to obtain a high boiling point of 300° C. or more, and the resulting high boiling point fraction was subjected to thermal modification at a temperature of 420° C. for 10 hours to obtain a pitch used as carbon fibers. Properties of atmospheric pressure distillation residual oils of Middle East crude oil A and Middle East crude oil B using as raw materials, those of the hydrogenated residual oil and the hydrogenated distillate oil after hydrogenation treatment, those of the high boiling point fraction after catalytic cracking treatment and those of the pitch used as a raw material for carbon fibers are shown in Table 1. Further, carbon fibers which were obtained by carrying out melt spinning of the above-described pitch used as a raw material for carbon fibers at 365° C., infusiblizing at 260° C. in the air and carbonizing at 1,000° C. had a tensile strength of 12 tons/cm$^2$ and a modulus of elasticity of 1,260 tons/cm$^2$. When the fibers prepared by carbonizing at 1,000° C. were additionally graphitized at 2,000° C., they had a tensile strength of 14 tons/cm$^2$ and a modulus of elasticity of 2300 tons/cm$^2$.

COMPARATIVE EXAMPLE 1

An atmospheric pressure distillation residual oil of Middle East crude oil A was subjected to thermal modification at a temperature of 410° C. for 15 hours. Properties of the atmospheric pressure distillation residual oil of Middle East crude oil A using as a raw material and those of the pitch are shown in Table 1. Further, carbon fibers which were obtained by carrying out melt spinning of the above-described pitch at 330° C., infusiblizing at 260° C. in the air and carbonizing at 1,000° C. had a tensile strength of 2.3 tons/cm$^2$ and a modulus of elasticity of 350 tons/cm$^2$. When the fibers prepared by carbonizing at 1,000° C. were additionally graphitized at 2,000° C., they had a tensile strength of 2.1 tons/cm$^2$ and a modulus of elasticity of 320 tons/cm$^2$.

COMPARATIVE EXAMPLE 2

An atmospheric pressure distillation residual oil of Middle East crude oil A was subjected to hydrogenation treatment in the presence of a cobalt-molybdenum catalyst under conditions comprising a temperature of 390° C., a pressure of 160 kg/cm$^2$G, a liquid space velocity of 0.5 per hour and a ratio of hydrogen/oil of 1,000 Nm$^3$/Kl to obtain a hydrogenated residual oil. The resulting hydrogenated residual oil was subjected to thermal modification at a temperature of 410° C. for 12 hours. Properties of the atmospheric pressure distillation residual oil of Middle East crude oil A which was used as a raw material, those of the hydrogenated residual oil and those of the pitch are shown in Table 1. Further, carbon fibers which were obtained by carrying out melt spinning of the above-described pitch at 330° C., infusiblizing at 260° C. in the air and carbonizing at 1,000° C. had a tensile strength of 3.1 tons/cm$^2$ and a modulus of elasticity of 340 tons/cm$^2$. When the fibers prepared by carbonizing at 1,000° C. were additionally graphitized at 2,000° C., they had a tensile strength of 2.9 tons/cm$^2$ and a modulus of elasticity of 330 tons/cm$^2$.

COMPARATIVE EXAMPLE 3

An atmospheric distillation residual oil of Middle East crude oil B was distilled under a reduced pressure to obtain a reduced pressure distillate oil having a boiling point of 300° to 550° C. (converting into values under an atmospheric pressure). The resulting reduced pressure distillate oil was subjected to hydrogenation treatment in the presence of a cobalt-molybdenum catalyst under conditions comprising a temperature of 370° C., a pressure of 60 kg/cm$^2$G, a liquid space velocity of 1.9 per hour and a ratio of hydrogen/oil of 360 Nm$^3$/kl to obtain a hydrogenated distillate oil. When the resulting hydrogenated distillate oil was subjected to thermal modification at a temperature of 400° C. for 50 hours, the yield of the pitch was very low and the pitch in an amount necessary to examine properties could not be obtained. Properties of the atmospheric pressure distillation residual oil of Middle East crude oil B which was used as a raw material and those of the hydrogenated distillate oil are shown in Table 1.

TABLE 1

| | Example 1 | Example 2 * | Example 2 ** | Comparative Example 1 | Comparative Example 2 | Comparative Example 3 |
|---|---|---|---|---|---|---|
| Properties of raw material | | | | | | |

TABLE 1-continued

| | | Example 1 | Example 2 * | Example 2 ** | Comparative Example 1 | Comparative Example 2 | Comparative Example 3 |
|---|---|---|---|---|---|---|---|
| Specific gravity | 15/4° C. | 0.955 | 0.960 | 0.955 | 0.955 | 0.955 | 0.960 |
| Kinetic viscosity | @ 50° C. cSt | 230 | 550 | 230 | 230 | 230 | 550 |
| Residual carbon content | wt % | 8.5 | 11.0 | 8.5 | 8.5 | 8.5 | 11.0 |
| S | wt % | 3.0 | 4.3 | 3.0 | 3.0 | 3.0 | 4.3 |
| N | ppm | 1,950 | 2,200 | 1,950 | 1,950 | 1,950 | 2,200 |
| V | ppm | 29 | 60 | 29 | 29 | 29 | 60 |
| Ni | ppm | 8 | 15 | 8 | 8 | 8 | 15 |
| Asphaltene content | wt % | 2.0 | 3.2 | 2.0 | 2.0 | 2.0 | 3.2 |
| Properties after hydrogenation treatment | | | | | | | |
| Specific gravity | 15/4° C. | 0.932 | 0.942 | 0.888 | | 0.932 | 0.888 |
| Kinetic viscosity | @ 50° C. cSt | 25.3 | 28.1 | 17.6 | | 25.3 | 17.6 |
| Residual carbon content | wt % | 5.7 | 7.1 | 0.04 | | 5.7 | 0.02 |
| S | wt % | 0.6 | 0.69 | 0.3 | | 0.6 | 0.3 |
| N | ppm | 630 | 790 | 170 | | 630 | 280 |
| V | ppm | 2.3 | 4.6 | 0.0 | | 2.3 | 0.0 |
| Ni | ppm | 2.1 | 3.4 | 0.0 | | 2.1 | 0.0 |
| Asphaltene content | wt % | 0.6 | 0.7 | 0.05 | | 0.6 | 0.07 |
| Properties of high boiling point fraction after catalytic cracking reaction | | | | | | | |
| Specific gravity | 15/4° C. | 1.080 | 1.019 | | | | |
| Kinetic viscosity | @ 50° C. cSt | 19.2 | 13.1 | | | | |
| Residual carbon content | wt % | 5.6 | 4.2 | | | | |
| S | wt % | 2.18 | 1.6 | | | | |
| Carbon content | wt % | 87.5 | 87.2 | | | | |
| Hydrogen content | wt % | 9.3 | 10.3 | | | | |
| Properties of pitch | | | | | | | |
| Specific gravity | 25/25° C. | 1.32 | 1.32 | | 1.29 | 1.31 | |
| Softening point | °C. | 327 | 340 | | 310 | 315 | |
| Quinoline insoluble content | wt % | 17.3 | 18.0 | | 25.0 | 23.6 | |

Note
*Raw material for obtaining hydrogenated residual oil
**Raw material for obtaining hydrogenated distillate oil While the invention has been described in detail and with reference to specific embodiments thereof, it will be apparent to one skilled in the art that various changes and modifications can be made therein without departing from the spirit and scope thereof.

What is claimed is:

1. A process for producing a pitch used as a raw material for producing carbon fibers, which comprises the steps of:

(A) catalytically cracking a hydrogenated residual oil having a sulfur content of 0.7% by weight or less, a vanadium content of 10.0 ppm or less, a nickel content of 5.0 ppm or less and an asphaltene content of 1.0% by weight or less, said hydrogenated residual oil being produced by subjecting a petroleum heavy residual oil to hydrogenation treatment in the presence of a hydrogenation catalyst at a temperature of 370° to 450° C., a pressure of 70 to 210 kg/cm$^2$G, a liquid space velocity of 0.4 to 2.0 per hour and a ratio of hydrogen/oil of 700 to 1,700 Nm/Kl, or catalytically cracking a mixture of said hydrogenated residual oil and a hydrogenated distillate oil having a sulfur content of 0.4% by weight or less, said hydrogenated distillate oil being produced by processing a petroleum heavy residual oil by reduced pressure distillation to prepare a reduced pressure distillate oil having 95% or more of a distillate fraction having a boiling point of 300° to 550° C. at atmospheric pressure, and subjecting the resulting distillate oil to hydrogenation in the presence of a hydrogenation catalyst at a temperature of 300° to 410° C., a pressure of 40 to 150 kg/cm$^2$G, a liquid space velocity of 0.5 to 3.0 per hour and a ratio of hydrogen/oil of 260 to 1,700 Nm$^3$/Kl, said catalytic cracking being carried out using a catalytic cracking catalyst at a temperature of 470° to 540° C., a pressure of 0.5 to 5.0 kg/cm$^2$G, and a ratio of catalyst:oil of 5:1 to 15:1 (by weight);

(B) distilling the resulting cracking oil to produce a high boiling point fraction having a boiling point of 300° C. or more; and (C) thermally modifying the resulting fraction at a temperature of 390° to 430° C. and a heating time of 1 to 30 hours.

* * * * *